United States Patent [19]

Brockl

[11] 4,161,272

[45] Jul. 17, 1979

[54] NAIL DRIVER CONSTRUCTION

[75] Inventor: Walter Bröckl, Oberndorf-Aistaig a.N., Fed. Rep. of Germany

[73] Assignee: Mafell-Maschinenfabrik Rudolf Mey KG, Fed. Rep. of Germany

[21] Appl. No.: 855,731

[22] Filed: Nov. 29, 1977

[30] Foreign Application Priority Data

Dec. 1, 1976 [DE] Fed. Rep. of Germany ..... 2654521

[51] Int. Cl.[2] ..... B25C 7/06

[52] U.S. Cl. ..... 227/131; 227/147

[58] Field of Search ..... 227/131, 147

[56] References Cited

U.S. PATENT DOCUMENTS 4,042,036 8/1977 Smith et al. ..... 227/131 X

*Primary Examiner*—Roy Lake
*Assistant Examiner*—Paul A. Bell
*Attorney, Agent, or Firm*—McGlew and Tuttle

[57] ABSTRACT

A nail driver for driving nails into a receiving surface comprises a housing with a release member movable upwardly and downwardly in the housing having a lower end which is engageable with the receiving surface. A nail guide channel is defined in the housing and it is arranged in association with a magazine for feeding nails into the channel in succession. A nail driver bar is movable upwardly and downwardly in the channel over the nail. A compression spring is engaged between the lower end of the release member and the nail driver so that when the release member is pressed against a surface, it may move upwardly against the force of the compression spring. The control mechanism is actuated by displacement of the release member to effect driving of a windup drum for a drive tape which is wound around the drum and connected at its free end to the upper end of the nail driver. The downward movement of the striking bar to drive the nail into the surface effects a movement on the release member so that it lifts the housing to permit the control connection to the winding drum to stop the winding drum after it is rotated back to raise the driving bar back to its starting position.

19 Claims, 5 Drawing Figures

NAIL DRIVER CONSTRUCTION

FIELD AND BACKGROUND OF THE INVENTION

This invention relates in general to nail drivers and, in particular, to a new and useful nail driver construction, comprising a striking bar for driving the nail out of a nail guide.

DESCRIPTION OF THE PRIOR ART

The drawback of a known nail driver having a movable striking bar is that the striking bar is actuated pneumatically. Consequently, such a nail driver can only be employed where compressed air is available, and thus its use is very limited. Since compressed air is frequently unavailable, the present invention is directed to a nail driver of the above-mentioned kind which is operable without compressed air.

SUMMARY OF THE INVENTION

In accordance with the invention, a nail driver is provided which includes a motor which drives the striking bar through a coupling mechanism, including an intermediate member which connects the rotary motor motion to an infeed motion of the striking bar. While using the nail driver, the motor, which is preferably an electrically driven motor, is put into operation and runs continuously at least up to the termination of the working stroke of the striking bar. A coupling mechanism must be actuated to start the working stroke. Thereby, the rotary motion of the motor is converted by means of the intermediate member into a translatory motion of the striking bar. This transforms the rotative moment of the motor and advantageously other parts, into striking energy. Should the nail have failed to leave the nail guide completely, i.e., if it has penetrated into the workpieces to be connected only partly, the striking operation may be repeated. However, since after the ramming, the coupling mechanism is automatically disengaged by the disconnecting device, the actuation of the driver must be repeated. In a very advantageous manner, the striking bar can be returned into its initial position against the action of a return spring. In consequence, the next stroke may follow the previous one immediately, without particular measures.

In a particularly preferred embodiment of the invention, the intermediate member comprises a tape, cable, chain or the like, having one of its ends secured to the striking bar and its other end connected to a cable pulley, sprocket wheel or the like, of the intermediate member, and the interaction is such that in the initial position of the striking bar, the tape, etc., is unwound from the cable pulley, while, in the working position of the striking bar, it is wound onto the cable pulley. To what extent the winding off and on is provided depends on the actual construction. By rotating the pulley in one direction, the striking bar is moved in the direction of the nail head, thereby, driving the nail head out of the nail guide. Upon rotation in the opposite direction, the striking bar is returned into its initial position. It will be understood that the greater the kinetic energy of the striking bar, the stronger the impact will be. Therefore, a rotational speed of the cable pulley as high as possible is sought, at least during the working stroke of the striking bar.

A high rotational speed of the pulley and a particularly rugged construction of the nail driver, at least in this area, is obtained, in accordance with a development of the invention, by designing the pulley as the planet carrier of a planetary gearing. The sun wheel of the planetary gearing is connected to the drive motor and the external gear is free to rotate while the coupling mechanism is disengaged. Upon starting the motor, the external gear of the planetary gearing it put into rotary motion through the sun wheel and the planet wheels. During this motion, the planet carrier, carrying a plurality of planet wheels is designed as a cable pulley and it stands still. Consequently, no force in the working direction is applied to the cable and to the striking bar.

If now, the external gear is stopped as abruptly as possible, by actuating the coupling mechanism, the cable pulley, with the planet wheels, is set in motion with the same abruptness and winds the cable on, which causes a highly accelerated and rapid working stroke of the striking bar. Thereby, the nail is expelled from the nail guide with such a great energy that, as a rule, it penetrates the parts to be connected upon a single stroke. In the above-described embodiment in which a planetary gearing is employed, no coupling, as conventionally understood, is used. Rather, the rotation of the cable pulley is started by means of a braking device by which the external gear of the planetary gearing is stopped as quickly as possible. It is easily possible, however, to use conventional coupling means, for example, a magnetic clutch, for breaking down the external gear, in which case, this gear would be designed as, or carry, a matching part of the coupling.

In a preferred embodiment of the invention, the coupling mechanism comprises a spring clutch and the external gear of the planetary gearing forms the continuously rotating part of this clutch. The spring of the clutch preferably surrounds the entire circumference of the external gear, without contacting it, in a disengaged position. In a suitable manner, i.e., by an applied mechanical force or by means of an auxiliary force, the spring, which is held fast by its both ends, is applied, in a preferred manner, against the outer circumference of the external gear in order to stop the rotary motion thereof as quickly as possible. In a further development, the invention provides that the spring clutch can be engaged by means of a pivotally mounted actuating member, particularly an actuating lever, and that one end of the clutch spring which, prior to the coupling engagement, surrounds the external gear without contacting the same, is secured to the actuating member, and the other end of the spring is secured to a fixed part of the housing of the nail driver. Of course, instead of a lever, another pivotal or displaceable member may be used which is capable of performing the motion needed for the working and back strokes of the striking bar.

In another embodiment of the inventive nail driver, comprising an actuating lever for a spring clutch, it is provided that the actuating lever is connected, through a control link, to a release member which is mounted for displacement within a housing or fixed housing part of the nail driver and can be retracted against the force of at least the clutch spring and displaced parallel to the striking bar. The striking bar projects, at least in its initial position, beyond the mouth of the nail guide in the nail drive direction. The control link, of course, is pivoted on both its ends, i.e., it is hinged on its one side to the actuating lever and, on its other side, it is hinged to the release member, in a manner such that a displacement of the release member against the nail drive direction causes the actuating lever to pivot in the right direction for engaging the spring to pivot in the right direction for engaging the spring clutch. This is obtained by an inclined position of the control link relative to the direction of displacement of the release member. At the release of the stroke, the control link continues to be righted, but does not reach the unstable position, nor an above-dead-center position.

Therefore, the spring-loaded release member returns automatically into its initial position after the pressure exerted thereon has ceased. The release member is displaced in its working direction by positioning the inventive nail driver in contact with the workpiece to be nailed and, after an exact alignment, by pushing the driver down. As the nail driver is lifted after the terminated stroke of its striking bar, the spring clutch disengages automatically. The motor then drives the external gear of the planetary gearing again, while the cable pulley, which is designed as a planet carrier, comes to a stop. Incidentally, the planet carrier, in addition, executes a rotary back motion as the striking bar returns into its initial position, which is preferably effected by means of a spring. The resistance to be opposed to the pushing-in of the release member must be chosen so that the striking bar performs its stroke only after the nail driver is quite intentionally pressed against the workpiece to be nailed. In any case, the nailing stroke must not be released merely by the weight of the nail driver itself.

The return spring of the striking bar may advantageously also serve as a return spring for the release member. In addition, according to a further development of the invention, the release member projects into the path of motion of the striking bar or of an extension thereof so that, at the end of the working stroke, the striking bar or its extension, impinges on the release member. Since the release member is in contact with the workpiece, this impingement of the striking bar or particularly of its lateral extension, during the last phase of the working stroke of the striking bar, causes a relative displacement between the nail driver and its release member, i.e., a lift of the nail guide and of all parts of the nail driver fixedly connected thereto, in a direction opposite to the working stroke of the striking bar. In this way, at the end of the working stroke of the striking bar, the spring clutch is automatically disengaged and a breakage of the wire rope etc., or other damages of the nail driver are securely prevented.

It is very useful to design the end of the release member facing the striking bar or extension thereof, for telescopic adjustment, particularly to provide it with a screw member. This member may be screwed in by an amount to set very accurately the instant at which the relative displacement of the release member and of the other parts of the nail driver has to take place.

According to another development of the invention, the release member and its guide structure are coupled to each other by a disengageable locking mechanism which can be brought into an ineffective position by a nail received in the nail guide. This provision prevents the release of the striking bar with an empty nail guide. The locking mechanism is put into action automatically after a working stroke, as soon as all elements have returned into their initial positions. The next working stroke cannot be released until another nail has been received in the nail guide.

In accordance with a preferred embodiment of the invention, the locking mechanism for the release member comprises a spring-loaded locking bolt which extends transversely to the longitudinal axis of the nail guide, the ends of which are each displaceable in an angular guide slot of the release member. In its initial position, the locking bolt is retained at the free end of that portion of each guide slot which extends transversely to the direction of motion of the striking bar and engages a locking recess of the guide structure of the release member. The locking bolt is displaceable, against the action of its loading spring or springs into the corner of the angular guide slot by the nail to be driven out. Thus, the locking and unlocking takes place in the transversely extending portion of the angular guide slot, while the longitudinally extending portion of the guide slot, i.e., the part parallel to the direction of motion of the striking bar, gives the necessary freedom of motion to the locking bolt during the working and back stroke of the striking bar.

It is particularly advantageous to provide the inventive nail driver with a nail magazine, the outlet of which is associated with the nail guide. From this magazine, the nails can be fed into the nail guide individually and in correct positions. The motor is advantageously designed as a high-speed electric motor, in particular, with an electronic speed control which may be effected stepwise or continuously. In this way, the striking energy can be adjusted to the actual need.

A particularly small and handy nail driver may be obtained by providing that the sun wheel of the planetary gearing is carried on, or integral with, the armature shaft of the drive motor.

Accordingly, it is an object of the invention to provide a nail driver which comprises a housing having a nail guide therein to which nails are fed in succession and which includes a striking bar movable in the housing for driving the nail out of the guide which is connected to a driving motor by means of a coupling mechanism and an intermediate member connected between the coupling mechanism and the striking bar for converting the rotary motion of the motor to an infeed movement of the striking bar and which also includes a disconnecting mechanism connected to the coupling mechanism for disengaging the coupling mechanism after the stroke of the striking bar automatically.

A further object of the invention is to provide a nail driver which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
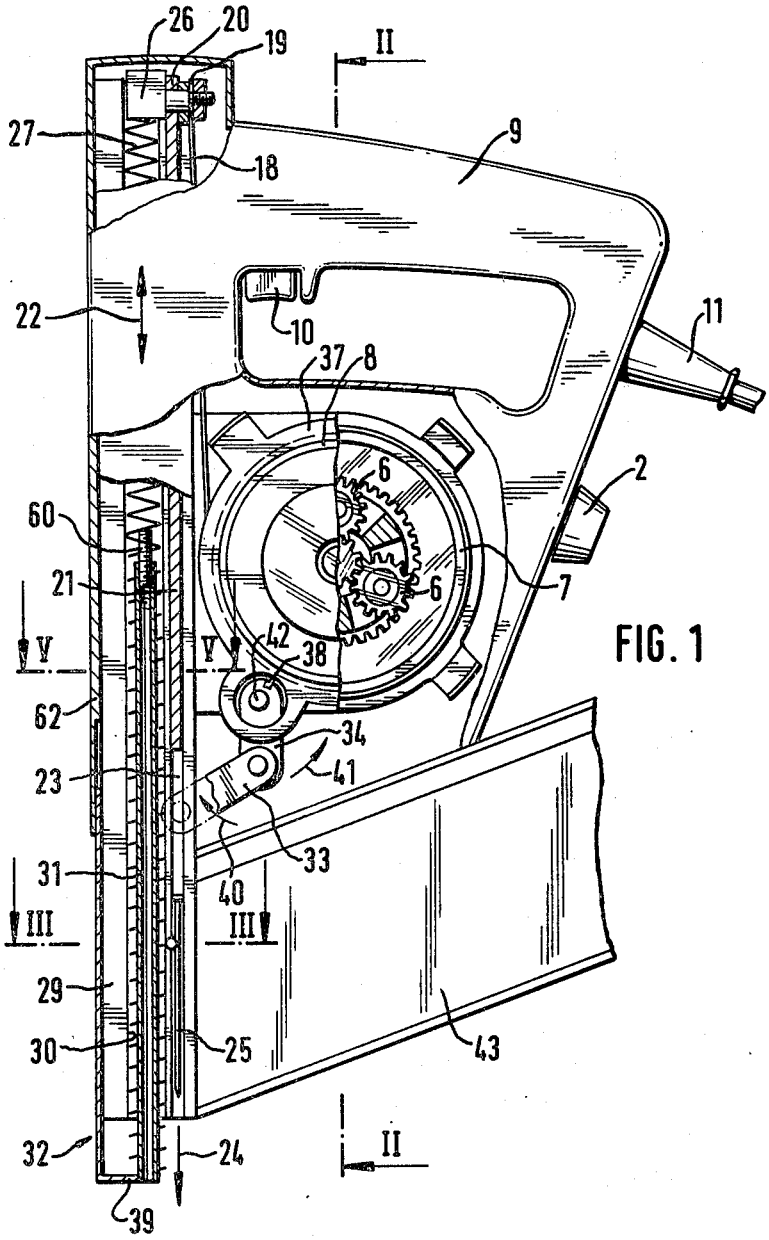
FIG. 1 is a partial elevational and partial sectional view of a nail driver constructed in accordance with the invention.
Figure 2:
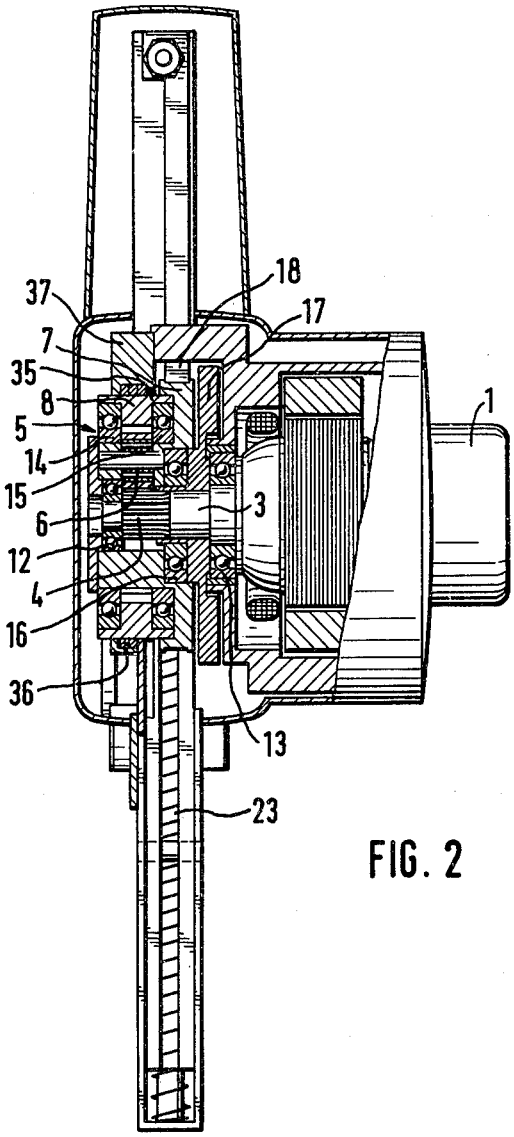
FIG. 2 is a partial sectional view taken along the line II—II of FIG. 1.

Referring to the drawings in particular, the invention embodied therein, comprises a nail driver for driving nails 25 to a receiving surface (not shown).

The inventive nail driver comprises an electric drive motor 1 which is designed as a very rugged universal motor having a flat armature. In order to adjust the striking energy to the varying nail lengths and thicknesses, motor 1 is provided with an electronic speed changer 2. This makes it possible to adjust the speed of the motor continuously or gradually. Armature shaft 3 carries a pinion forming the sun wheel 4 of a planetary gearing 5 on its free end portion. The plant gears 6 are mounted for rotation, in a well-known manner, on a planet carrier 7 of the planetary gearing and, in this particular embodiment, the carrier is designed as a rope pulley 7. Planet gears 6 mesh simultaneously with the internal teeth of external gear 8. As soon as motor 1, which is supplied with current through an electrical line 11 is started, by pushing down a pushbutton 10 of an off-on switch (not shown) provided on the handle 9 of the nail driver, the pinion or sun wheel 4 drives external gear 8 through the planet gears 6. The planet carrier, designed as rope pulley 7, does not rotate along.

The armature shaft 3 is supported in two ball bearings 12 and 13. Ball bearings 14 and 15 are provided to support external gear 8. The inner races of ball bearings 14 and 15 are carried by a tubular extension of rope pulley 7. The rope pulley 7 is itself mounted for rotation on a tubular neck of a disc 17 by means of a ball bearing 16. One end of an elastic tape 18 is secured to rope pulley 7. The other end 19 of tape 18 is attached to the upper end 20 (FIG. 1) of a striking bar or nail driver 21. The tape 18 is exchangeable and is preferably made of steel. Striking bar 21 is displaceable up and down, as indicated by an arrow 22, in a guide 23 which conforms to the cross-section of the bar. The working stroke direction of the bar is indicated in FIG. 1 by an arrow 24.

The lower end (FIG. 1) of guide 23 for striking bar 21 also serves as a nail guide for a nail 25. As the free end of the striking bar impinges on the nailhead, the nail is driven out with great force from the nail guide in the direction of arrow 24 and is rammed into the parts to be connected to each other. How the working stroke is produced will be explained hereinafter. In this connection, it should merely be noted that the striking bar 21 is pulled downwardly by means of elastic tape 18 which is wound on rope pulley 7 for this purpose. Striking bar 21 carries a cam or extension 26 on its upper end, and a return spring 27 in the form of a helical compression spring is provided which bears against extension 26. The working stroke in direction 24 is performed against the action of the spring 26. As soon as the pull on elastic tape 18 is stopped, spring 27 returns striking bar 21 and all the parts moved therewith into their initial positions.

The guide structure 23 is formed by two rail parts 28 and 29 which are substantially of symmetrical shape relative to each other. The spring 27 is received in a cylindrical bore 30 extending parallel to guide structure 23. A tube 31, forming part of a release member 32 for the working stroke, projects into the lower part of spring 27. This release member 32 is displaceable in a compartment of housing part 62.

Release member 32 is hinged to a control link 33, the other end of which is pivoted to an actuating lever 34 of a coupling mechanism 35. This coupling mechanism comprises a so-called spring clutch including a spring 36 which surrounds external gear 8 without contacting the same. This spring has the shape of a helical spring having its both ends angled outwardly. In the present example, about two and a half spring turns are provided. The cross-section of the spring wire is square or rectangular. One of the angled spring ends (not shown) engages in a recess of a ring 37 which surrounds external gear 8 and extends laterally over spring 36. The other end 38 of the spring is inserted into a radial slot of actuating lever 34.

The inventive nail driver operates as follows: The lower end 39 of release member 32 is put in contact with the workpiece surface into which the nail is to be rammed. After starting electric motor 1, external gear 8 is driven through pinion 4 and planet wheels 6, while pulley 7 remains at rest at that time. If the nail driver is now pressed against the workpiece or the like (not shown) in the direction of arrow 24, release member 32 is displaced relative to rail parts 28 and 29 and, thereby, of course, also relative to the entire nail driver.

At the same time, return spring 27 is also slightly compressed. This inward displacement of release member 32 causes a pivotal motion of control link 33 in the direction of arrow 40. This, in turn, causes a pivotal motion of actuating lever 34 in the direction of arrow 41, about axis 42 of the lever. The end portion of spring 36 in slot 38 of coupling mechanism 35 is thereby also displaced counter-clockwise. Since the other end of the spring is held fast at the same time, however, the turns of spring 36 are contracted. In consequence, they apply against the cylindrical outer surface of external gear 8 of planetary gearing 5.

A firm frictional contact is produced by which external gear 8 is abruptly braked. However, since pinion or sun wheel 4 of planetary gearing 5 continues rotating, the planet carrier or pulley 7 hitherto standing still is forced to rotate. This rotary motion starts as abruptly as the motion of external gear 8 has been stopped. Even though a braking action is involved, the entire operation may be designated as a coupling of rope pulley 7.

In the embodiment shown, the parts mentioned in this paragraph form the coupling mechanism 35. The rotating pulley 7 immediately starts to wind up elastic tape 18 and this results in a displacement of striking bar 21 in the direction of arrow 24, i.e., in a working stroke and expulsion of nail 25 from the nail guide.

As already explained, extension 26 also moves in the direction of arrow 24, along with striking bar 21. As soon as nail 25 is completely set in the parts to be connected, extension 26 impinges an associated end of tube 31 of release member 32. The nail driver housing is thereby lifted relative to release member 32 resting on the workpiece, against the direction indicated by arrow 24. Due to this lift, actuating lever 34 and control link 33 can pivot back. This results in a relaxation of spring 36 of the spring clutch. External gear 8 is thereby set free and recommences its rotary motion. The drive of pulley 7 is also interrupted. The pulley executes only a short rotary back motion until striking bar 21 again reaches its upper or initial position (FIG. 1). A similar lifting motion also takes place in cases where the nail, upon the first stroke, did not penetrate or only penetrated partly into the workpieces. If the nail still extends into the nail guide, further working strokes may be produced by repeatedly pushing down the driver.

Figure 4:
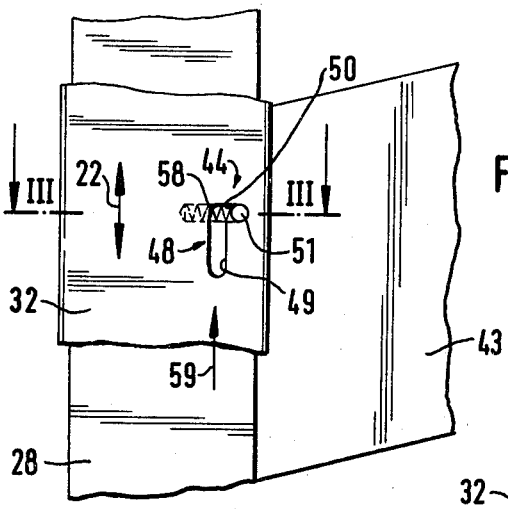
FIG. 4 is an enlarged partial elevation view of the portion shown in FIG. 3.
Figure 3:
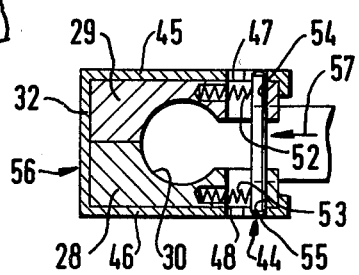
FIG. 3 is a section taken along the line III—III of FIG. 1.
Figure 5:
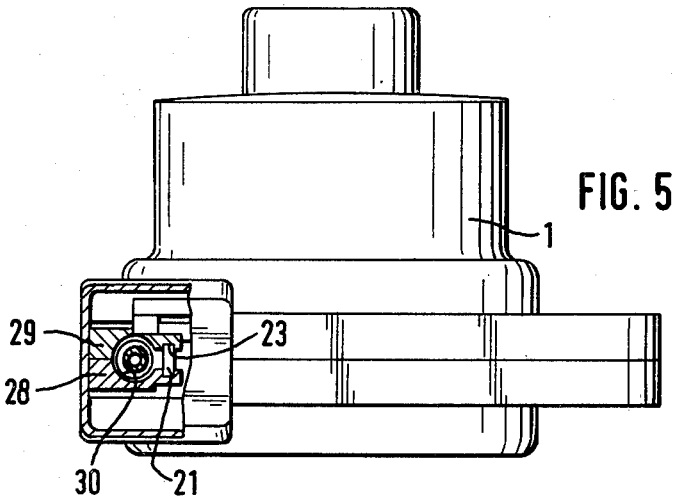
FIG. 5 is a top plan view of the driver, partly in section, taken along the line V—V of FIG. 1.

The nails 25 are supplied to the nail guide automatically through a magazine 43. To prevent an idle stroke of striking bar 21, for example, if the magazine 43 is completely empty, a locking mechanism 44 is provided which, in its substantial design, is shown in FIGS. 3 and 4. Release member 32 embracing rail parts 28 and 29 from the outside is provided with an angled guide slot 47, 48 in each of its two parallel walls 45, 46. A slightly longer portion 49 of the slot extends parallel to the working direction of the striking bar 21, while the slightly shorter portion 50 of the slot extends transversely, particularly perpendicularly thereto, and toward magazine 43.

The ends of a cross bolt 51 are held by means of two load springs 52, 53 at the free end of each of these slot portions 50. The springs are supported in bores of rail parts 28, 29. At the same time, cross bolt 51 engages a locking recess 54, 55 of the guide structure 56 formed by the two rail parts 28, 29. This prevents relative displacement of guide structure 56 and release member 32 in the directions shown by the arrow 22.

If a nail is now fed from the magazine in the direction of arrow 57, during its motion, the nail pushes bolt 51 crossing its path, from the righthand to the lefthand side (FIG. 1). Upon arrival of the nail in the nail guide, cross bolt 51 arrives in the corner 58 of angled guide slot 47, 48. This enables release member 32 to move upwardly on guide structure 56 in the direction of arrow 59, with the cross bolt moving into slot portions 49. The locking position is reoccupied automatically as soon as the working stroke is terminated and no new nail is fed into the nail guide.

It should be noted that a threaded bolt 60 is screwed into the free end portion of tube 31 of release member 32, making it possible to exactly adjust the instant of lifting the nail driver relative to the release member. A small mass of the striking bar and the planet carrier is provided in order to reduce the energy consumption needed for accelerating these parts to the necessary speed. The speed of the planet carrier and, thereby, of the striking bar 21 is provided only in a magnitude ensuring the ramming of the nail. This speed is lower than that of the motor to permit use of mechanical means, such as, a coupling mechanism.

While a specific embodiment of the invention has been shown and described in detail to illustrate the application of the principles of the invention, it will be understood that the invention may be embodied otherwise without departing from such principles.

What is claimed is:

1. A nail driver, comprising a housing having a nail guide therein, a striking bar movable in said housing for driving the nail out of said nail guide, a motor in said housing, a coupling mechanism connected to said motor including a rotatable pulley driven by said motor, an intermediate member connected between said coupling mechanism and said striking bar for converting the rotary motion of the motor into an infeed movement of the striking bar including a flexible tape having one end secured to said striking bar and an opposite end connected to said pulley and being wound around said pulley for being driven thereby to move said striking bar, and a disconnecting mechanism connected to said coupling mechanism for disengaging the coupling mechanism after the stroke of said striking bar automatically.

2. A nail driver, as claimed in claim 1, including a return spring displacing said striking bar in a return direction, said striking bar being displaceable into a working position against the action of said return spring.

3. A nail driver, comprising a housing having a nail guide therein, a striking bar movable in said housing for driving the nail out of said nail guide, a motor in said housing, a coupling mechanism connected to said motor and an intermediate member connected between said coupling mechanism and said striking bar for converting the rotary motion of the motor into an infeed movement of the striking bar, and a disconnecting mechanism connected to said coupling mechanism for disengaging the coupling mechanism after the stroke of said striking bar automatically, including a return spring displacing said striking bar in a return direction, said striking bar being displaceable into a working position against the action of said return spring, said intermediate member comprising a flexible tape having one end secured to said striking bar and having an opposite end, a pulley connected to the opposite end of said tape, said tape in an initial position of said striking bar being unwound from said pulley and in the final nail driving position of the striking bar, said tape being wound on said pulley.

4. A nail driver, as claimed in claim 3, including a planetary gearing having a planet carrier comprising said pulley, and also having a sun wheel, said drive motor being connected to said sun wheel to rotate said sun wheel, an external gear surrounding said sun wheel and spaced radially outwardly therefrom, said planet carrier having a plurality of planet gears engaged between said sun gear and said external gear, said external gear being rotatable when said coupling mechanism is disengaged.

5. A nail driver, as claimed in claim 4, wherein said coupling mechanism comprises a spring clutch, said external gear of the planetary gearing forming a rotatable part which is engaged by said spring clutch, said spring clutch acting to stop said external rotating gear and to permit rotation of said pulley.

6. A nail driver, as claimed in claim 5, wherein said coupling mechanism includes an actuating lever, said clutch spring surrounding said external gear without contacting said gear tightly and having one end secured in a fixed position, and an opposite end connected to said lever to permit tightening engagement of said clutch spring with said external gear.

7. A nail driver, as claimed in claim 6, including a release member slidable in said housing, spring means biasing said release member in a downward direction, said release member being engageable with the receiving surface and being pressable against said spring means to move in said housing, said actuating lever being connected to said release member and being movable by movement of said release member to engage said clutch spring with said external gear, said release member having a portion movable out of said housing ahead of the nail guide which may be moved inwardly by engagement with the surface.

8. A nail driver, as claimed in claim 7, wherein said spring means comprises a compression spring compressed between said release member and said striking bar.

9. A nail driver, as claimed in claim 7, wherein the release member projects into the path of motion of the striking bar or of an extension connected thereto and, at the end of the working stroke, the striking bar or extension thereof impinges on the release member.

10. A nail driver, as claimed in claim 9, wherein said release member includes a tubular portion having an upper threaded end with a screw member threaded into said upper threaded end.

11. A nail driver, as claimed in claim 7, including a locking device for blocking the movement of said release member including a pin engageable with said release member to hold it against movement, said pin being displaceable by the insertion of a nail in said guide channel to release said release member.

12. A nail driver, as claimed in claim 11, wherein said locking device pin comprises a locking bolt, a loading spring acting on said bolt to urge it into engagement with said release member, said release member having a groove which is alignable with the bolt to receive the bolt in an initial position of said release member so as to lock said release member, said guide channel having an entrance position for a nail to be driven at the location of said bolt engageable with the bolt to displace it out of the groove of said release member.

13. A nail driver, as claimed in claim 12, including a nail magazine connected to the opening to said guide channel for positioning nails in succession into the opening.

14. A nail driver, as claimed in claim 13, wherein said electric motor comprises a high speed electric motor and includes an electronic speed control for said motor.

15. A nail driver, as claimed in claim 14, wherein said sun wheel is carried by or is integral with the armature shaft of said electric motor.

16. A nail driver for driving nails into a receiving surface, comprising a housing, a release member having an upper end movable in said housing and having a lower end engageable with the receiving surface, a nail guide channel defined in said housing for the positioning of a nail in said housing, a nail driver bar movable upwardly and downwardly in said channel over the nail, spring means urging said release member so that the lower end thereof projects out of said housing, a rotatable pulley, motor means for rotating a rotatable shaft for driving said pulley, clutch means between said shaft and said pulley for rotating said pulley at selected times, a flexible connecting member extending between said pulley and said nail driver bar being windable on said pulley upon rotation of said pulley, control means connected to said release member and being actuated by movement of said release member against the receiving surface connected to said coupling means to cause said coupling means to drive said pulley to wind up the flexible member and cause the movement of the driver to drive the nail into the surface.

17. A nail driver, as claimed in claim 16, wherein said drive motor has a rotatable shaft, a sun gear affixed to said shaft for rotation therewith, an annular external gear surrounding said sun gear, a planet gear carrier pulley having a plurality of planetary gears in meshing engagement with and positioned between said internal gear and said sun gear, said pulley having an exterior pulley portion, clutch means engageable around said external gear to hold said external gear against rotation and thereby to permit rotation of said pulley to wind up said flexible member and to move said driver bar to drive a nail into the receiving surface.

18. A nail driver for driving nails into a receiving surface, comprising a housing, a release member having an upper end movable in said housing and a lower end engageable with the receiving surface, a nail guide channel defined in said housing, for the positioning of a nail in said housing, a nail driver bar movable upwardly and downwardly in said channel over the nail, a compression spring engaged between the lower end of said release member and said nail driver urging said release member lower end out of the housing, a motor having a rotatable shaft in said housing, a sun gear affixed to said shaft for rotation therewith, an annular external gear surrounding said sun gear being radially spaced outwardly therefrom, a planet gear carrier having at least one planet gear in meshing engagement with and positioned between said external gear and said sun gear, said planet gear carrier pulley having an exterior pulley portion, means engageable around the external gear to hold said external gear against rotation and thereby to permit rotation of said pulley, a flexible tape having one end connected to said driver bar and an opposite end engaged on and windable upon said pulley portion and being rotatable upon movement of said pulley to move said nail driver downwardly in said channel to drive a nail positioned in said channel out of the channel and into the receiving surface, and control means connected to said release member and to said means engageable around said external gear for tightening said means upon movement of said release member against the force of said compression spring, said release member being movable after the nail is driven to urge the housing upwardly in respect to said release member, and free said control means to permit loosening of said external gear after said winding pulley permits return of said driving member to an initial position.

19. A nail driver, as claimed in claim 18, including blocking means engageable with said release member to block the release member whenever a nail is not positioned in the channel.

* * * * *